US005492279A

United States Patent [19]

Strich

[11] Patent Number: 5,492,279

[45] Date of Patent: Feb. 20, 1996

[54] VARIABLE SPRING RATE PULVERIZER APPARATUS

[75] Inventor: Gregory R. Strich, Enfield, Conn.

[73] Assignee: Combustion Engineering, Inc., Windsor, Conn.

[21] Appl. No.: 313,959

[22] Filed: Sep. 28, 1994

[51] Int. Cl.[6] ..... B02C 9/04

[52] U.S. Cl. ..... 241/121; 241/288; 110/106

[58] Field of Search ..... 110/106, 104 R, 110/101 R; 241/119, 120, 121, 288, 289, 290

[56] References Cited

U.S. PATENT DOCUMENTS

| | | | |
|---|---|---|---|
| 810,830 | 1/1906 | Wegerif | 241/121 |
| 2,131,801 | 10/1938 | Gruender | 241/289 |
| 2,461,176 | 2/1949 | Piper | 241/119 |
| 4,372,496 | 2/1983 | Maliszewski | 241/121 |

FOREIGN PATENT DOCUMENTS

| | | | |
|---|---|---|---|
| 1321465 | 7/1987 | U.S.S.R. | 241/121 |
| 1435287 | 11/1988 | U.S.S.R. | 241/121 |

*Primary Examiner*—Thomas E. Denion
*Attorney, Agent, or Firm*—Robert S. Smith

[57] ABSTRACT

A pulverizer for crushing coal for use in a combustion process includes a bowl shaped body, a roller dimensioned and configured for contact with at least a portion of the bowl shaped body, apparatus for causing relative movement between the bowl shaped body and the roller; and apparatus for biasing the roller against the bowl shaped body, the apparatus for biasing including a spring assemblyat includes a first spring and a second spring. The apparatus means for biasing including apparatus allowing initial compression of the first spring before the second spring is compressed. In some forms of the invention the first spring and the second spring are coil springs and the first and second springs are compressed simultaneously after initial compression of the first spring. In other forms of the invention the first and second springs are disposed in coaxial relationship with the second spring overlapping an axial part of the first spring. In this form of the invention the second spring has a free axial length that is less than the free axial length of the first spring. The apparatus allowing initial compression may include a washer disposed at one axial extremity of the first spring and a spring seat disposed at a second axial extremity of the first spring. The apparatus may include a shaft extending between the spring retainer and the washer, the shaft may include apparatus for preloading the first spring without preloading the second spring. The first spring and the second spring may be disposed in substantially coaxial substantially end abutting relationship and the apparatus may include a floating plate disposed intermediate the first and second springs. A generally sleeve shaped member may surround at least an axial portion of the first spring and the first spring may have a lower spring constant than the second spring. The generally sleeve shape member may extend around a portion of the axial extent of the first spring and the sleeve shape member may be dimensioned and configured for engagement with the floating plate after initial compression of the first spring whereby after contact of the sleeve shape member with the floating plate the first spring will not compress axially any further. In some forms of the invention the apparatus includes apparatus for compressing the first and second springs simultaneously whereby both the first and second springs are preloaded.

11 Claims, 3 Drawing Sheets

VARIABLE SPRING RATE PULVERIZER APPARATUS

BACKGROUND OF THE INVENTION

The invention relates to pulverizers of the type that are used in pulverized coal fired steam generating systems. More particularly, the invention relates to pulverizers that will function well at both low load conditions and high load conditions.

Pulverized coal firing is favored over other methods of burning coal because pulverized coal burns like gas and, therefore, fires are easily lighted and controlled.

Pulverizers, also referred to as mills, are used to grind or comminute the fuel. The present invention has primary application to bowl pulverizers or mills. Although the present invention will be described with respect a bowl type ring roll pulverizer. Those skilled in the art will recognize that the invention may be used in other bowl type mills as well.

The force required to urge the cooperating elements in such pulverizers toward each other varies substantially with the load requirements. In other words at high load conditions (when there is a high coal flow rate), the force requirements are much greater than at low load conditions (when there is a low coal flow rate). Environmental concerns have been the basis for limiting emissions of nitrogen monoxide and nitrogen dioxide as byproducts of the combustion process used in steam generating systems. Systems to reduce such emissions have lowered the temperature of combustion tending to result in the undesirable side effect of increasing the carbon content in the ash. One countermeasure to reduce the carbon content of the ash is to provide finer particles of coal to the combustion process. In other words, in systems that meet the nitrogen monoxide and nitrogen dioxide emission requirement, if finer coal particles are burned in the combustion process the amount of carbon in the ash will less than if coarser coal particles are burned in the combustion process. Accordingly, there is an increasing demand for coal pulverizers that will produce the desired small particles.

Pulverizers operating at low load conditions to produce particles that are very fine tend to run roughly. This roughness is due to the relative thinness of the coal bed in the bowl in which the coal is being crushed. (It will be understood that the term "coal bed" refers to the layer of coal disposed intermediate the roll and the bowl in the pulverizer.) Conventional spring biased pulverizers have constructed with a design trade-off. On the one hand, the spring rate may be selected so as to be compatible with the low load condition. With this selection the spring rate will be inadequate at high load conditions. The inadequate spring rate means that the mill will produce less fineness at high load conditions and the mill will be unable to maintain the required throughput. The failure to maintain the required throughput will commonly result in spillage of the coal because the coal will overflow the bowl of the pulverizer.

On the other hand, if they spring rate is chosen to the appropriate for high feed rates the pulverizer will have too high a spring force at low flow rates. The effect of a spring rate that is too high is that too much power is required to drive the mill, there is excessive wear on the components resulting in increased maintenance and decreased component time to failure, excessive crushing of the coal resulting in excessive fineness and thus greater fan power requirements to blow the crushed coal into the combustion area.

Variable rate coil springs are known in relatively small sizes. Such variable rate springs may, for example, have axial sections of differing coil diameters or different spacing between turns or other characteristics that differ in separate axial sections. The springs required for pulverizers are much larger. The specific physical characteristics will vary with the application, however the spring rates may be in the order of 2000–40,000 pounds per inch of deflection, the spring may be manufactured from two or three inch bar stock, the diameter may be fourteen or sixteen inches, and the spring may be two feet long. Although these numbers are only representative, it will readily be seen and understood by those skilled in the art that variable rate springs having such very large sizes have not been produced because of the expense of tooling for their manufacture and because the reliability of such devices is not known.

It is an object of the invention to provide a pulverizer which will produce very fine coal particles at both low load conditions and high load conditions.

It is also an object of the invention to provide a mechanism that will produce a variable rate spring effect in an assembly that incorporates only constant rate springs.

It is still another object of the invention to produce apparatus which will be highly reliable.

Still another object of the invention is to produce an apparatus which is relatively inexpensive to manufacture.

SUMMARY OF THE INVENTION

It has now been found that these and other objects of the invention may be attained in a pulverizer for crushing coal for use in a combustion process includes a bowl shaped body, a roller dimensioned and configured for contact with at least a portion of the bowl shaped body, means for causing relative movement between the bowl shaped body and the roller; and means for biasing the roller against the bowl shaped body, the means for biasing including a spring assembly, the spring assembly including a first spring and a second spring, the means for biasing including means causing initial compression of the first spring before the second spring is compressed.

In some forms of the invention the first spring and the second spring are coil springs and the first and second springs are compressed simultaneously after initial compression of the first spring.

In some forms of the invention the first and second springs are disposed in coaxial relationship with the second spring overlapping an axial part of the first spring. In this form of the invention the second spring has a free axial length that is less than the free axial length of the first spring.

The means allowing initial compression may include a washer disposed at one axial extremity of the first spring and a spring seat disposed at a second axial extremity of the first spring. The apparatus may include a shaft extending between the spring retainer and the washer, and may include means for preloading the first spring without preloading the second spring.

The first spring and the second spring may be disposed in substantially coaxial substantially end abutting relationship and the apparatus may include a floating plate disposed intermediate the first and second springs. A generally sleeve shaped member may surround at least an axial portion of the first spring and the first spring may have a lower spring constant than the second spring. The generally sleeve shape member may extend around a portion of the axial extent of the first spring and the sleeve shape member may be dimensioned and configured for engagement with the floating plate after initial compression of the first spring whereby after contact of the sleeve shape member with the floating plate the first spring will not compress axially any further.

In some forms of the invention the apparatus includes means for compressing the first and second springs simultaneously.

BRIEF DESCRIPTION OF THE DRAWINGS

The invention will be better under stood by reference to the accompanying drawing in which.

DESCRIPTION OF THE PREFERRED EMBODIMENTS

Figure 1:
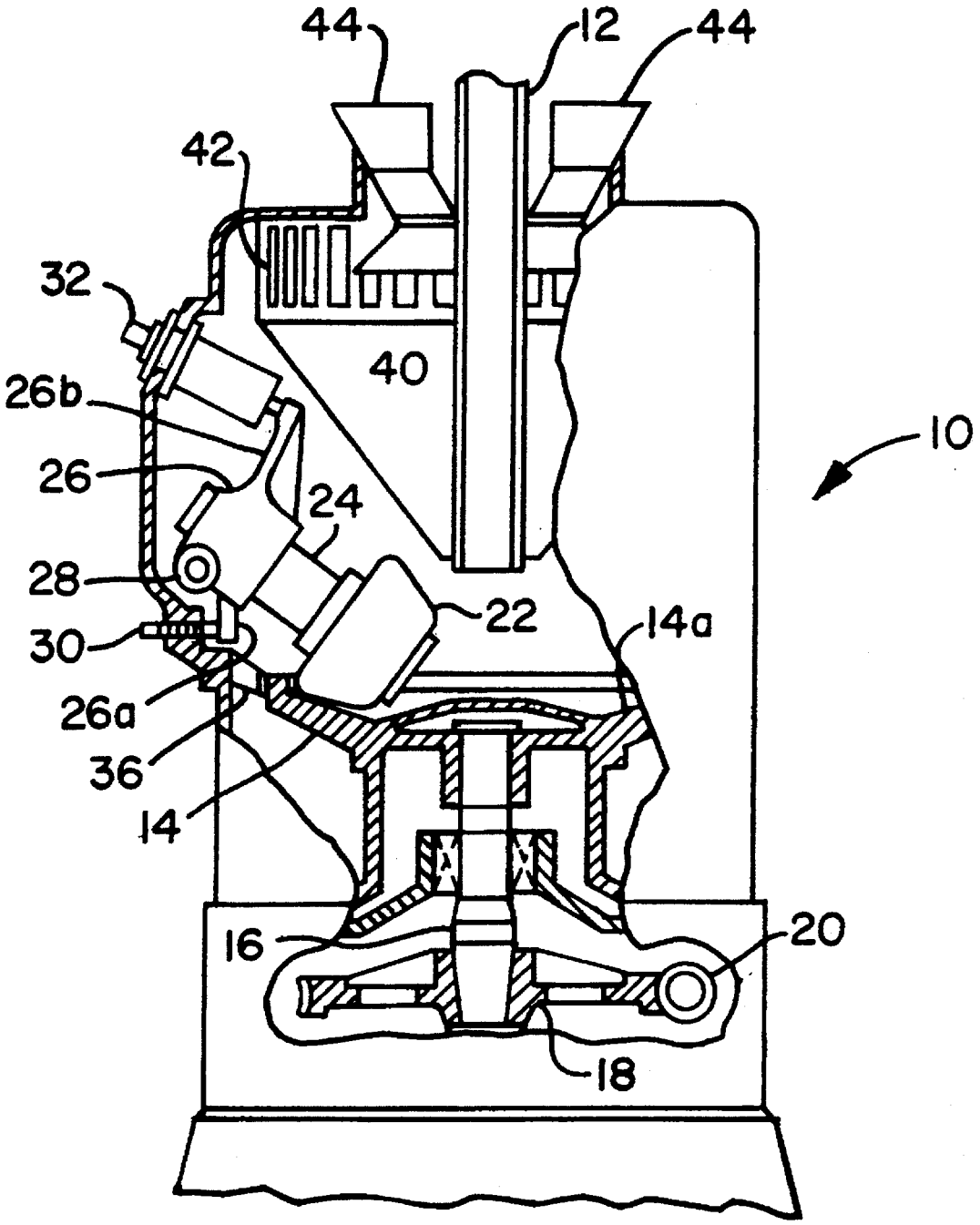
FIG. 1 is an elevational view, partially broken away and partially in section of a pulverizer in accordance with one form of the present invention.

Referring now to FIG. 1, there is shown a pulverizer 10 having an inlet 12 through which the coal to be pulverized is fed. The coal falls into a bowl 14 that is fixed to a vertical shaft 16. A worm gear 18 is fixed to the shaft 16. A worm 20 is driven by a motor (not shown). Accordingly, the motor drives the worm 20 to drive the worm gear 18 to turn the shaft 16 and thus turn the bowl 14.

The upper face of the bowl 14 is generally dish shaped. More particularly, the upper face includes a surface 14*a* that is dimensioned and configured for cooperation with a grinding roll 22. The grinding roll 22 has a truncated conical form.

The grinding roll 22 is mounted for rotation on a shaft 24 that is carried on a journal assembly 26. The journal assembly 26 is mounted for pivotal motion about an axle 28. An adjustable stop 30 cooperates with a finger of the journal assembly 26. More particularly, the stop 30 allows adjustment to provide clearance between the grinding roll 22 and the face 14*a*.

The journal assembly 26 is biased by a spring assembly 32 so that it rotates about the axle 28 and abuts the stock 30. Those skilled in the art will recognize that ordinarily some clearance is desired intermediate the grinding roll 42 and the face 14*a*.

The present invention relates to the construction of the spring assembly 32. The prior art and various embodiments of the spring assembly 32 in accordance with the invention will be described hereafter.

In operation, hot air is fed into the pulverizer 10 beneath the bowl 14. That air is directed past the vanes 36 in the region around the bowl 14. The hot air flows past the vanes 36 into the grinding area above the bowl 14.

The hot air flows upwardly around the truncated cone shaped classifier assembly 40. The classifier assembly 40 includes a plurality of openings 42 at the upper part thereof.

Finely ground coal is carried by the hot air from the area above the bowl 14 through the openings 42 and out the exits 44, 44. Particles that are not as finely ground will fall, due to the effects of gravity, back down through the classifier assembly 40 and onto the face 14*a* of the bowl 14 where they will be ground further until the particles are more finely ground.

Although only one such grinding roll 22, shaft 24, and journal assembly 26 is shown in FIG. 1, it will be understood by those skilled in the art that ordinarily each pulverizer 10 of this general type will have three identical grinding rolls 22. Each of the grinding rolls 22 is carried on a shaft 24 that is carried in a journal assembly 26. Each of the three journal assemblies 26 is pivoted on an axle 28 and each is biased into position by a spring assembly 32.

Figure 5:
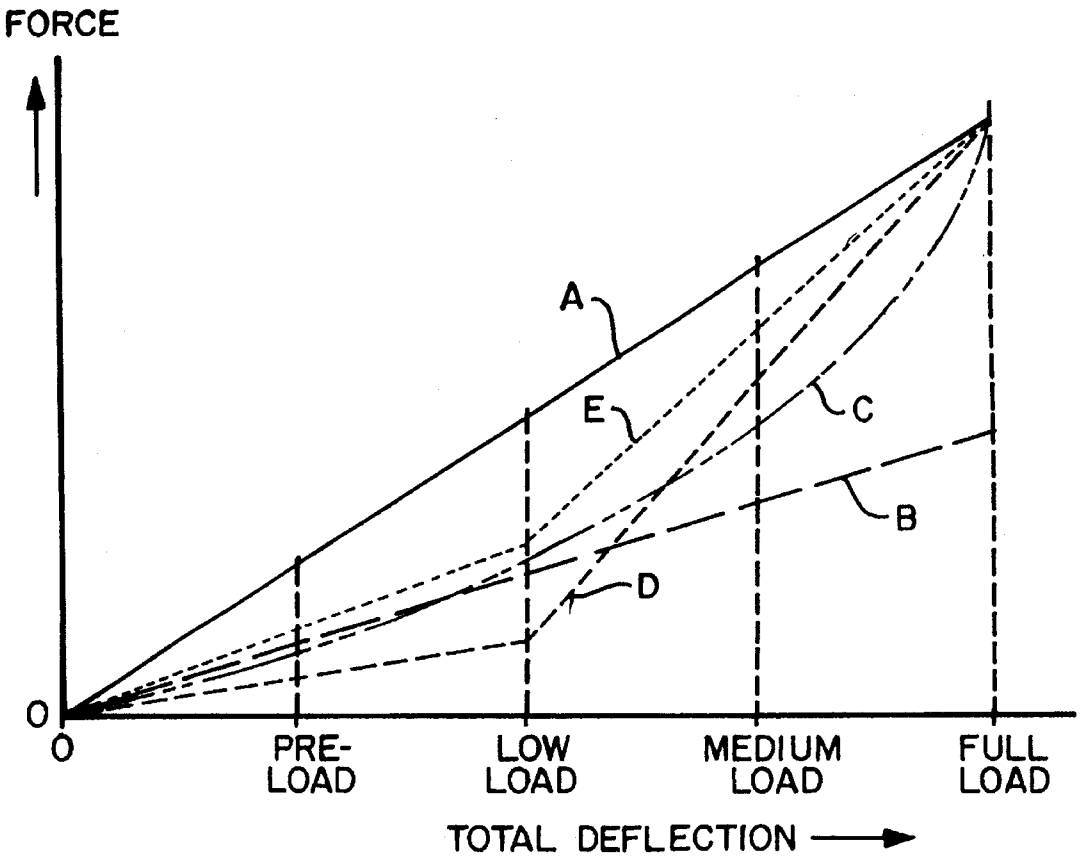
FIG. 5 is a chart showing the relationship between force and deflection for various spring assemblies and particularly illustrating the rate at preload, low load, medium load, and full load conditions.

Referring now to FIG. 5 there is shown a curve C that represents an idealized spring rate at various load conditions. It is theoretically possible to manufacture a single spring having such characteristics in the sizes required, however, it is highly impractical to do so with present manufacturing capabilities. In addition the reliability of any such large variable rate spring is not certain. This theoretically ideal spring has the characteristic that for a given increase in deflection a much higher force is required in the medium load range than in the low load range. Similarly, a much, much higher force is required for the same amount of deflection in the full load range than in the low load range.

Figure 2:
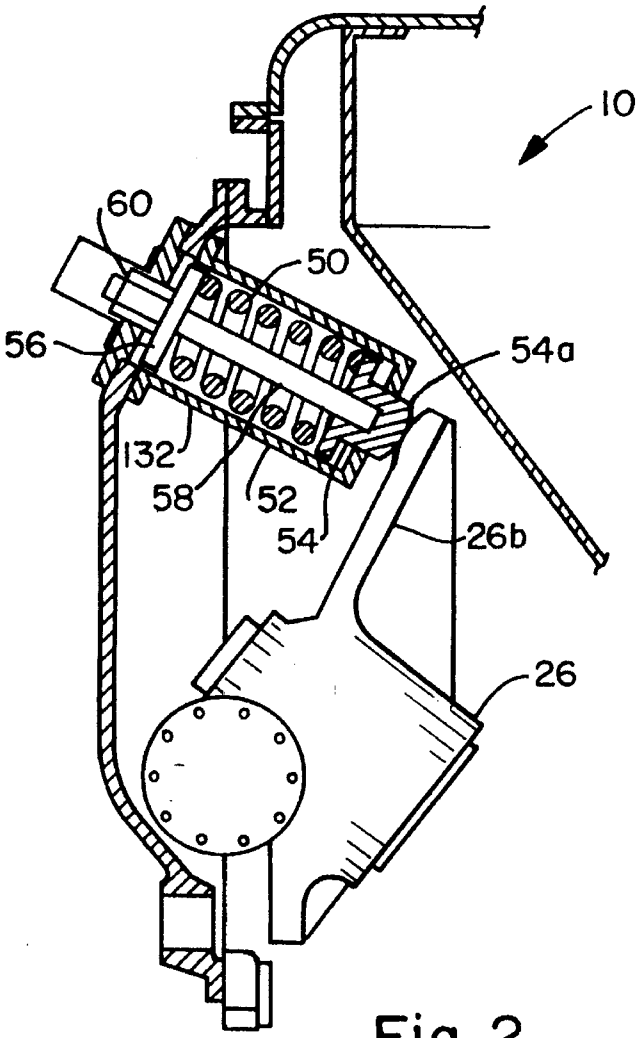
Fig. 2 (PRIOR ART)
FIG. 2 is a fragmentary view of the prior art spring Assembly.

In the prior art structure shown in FIG. 2 there is shown a spring assembly 132 that incorporates a single constant rate spring 50. In a conventional manner the spring 50 is disposed within a tube or canister 52. At one axial extremity of the spring 50 there is a seat 54 that is generally circular and dimensioned and configured for sliding movement within the canister 52. The seat 54 has a centrally disposed head 54*a* that abuts the arm 26*b* of the journal assembly 26 and thus biases the journal assembly 26 to pivot about the axle 28 toward the face 14*a* of the bowl 14. The spring 50 is further captured within the tube 52 by a washer 56 that rides on a central shaft 58.

The central shaft 58 extends within and is fixed to the head 54*a*. A nut 60 is torqued prior to actual operation to provide a preload on the spring 50. As described in the Background of the Invention section of this application there are disadvantages to much force and too little force. A spring 50 that has been dimensioned and configured for low load conditions will have an inadequate force per increment of deflection at high load conditions. In other words there will be insufficient force on the bed of coal between the roller 22 and the bowl 14. This is illustrated graphically by line C in FIG. 5.

If the conventional spring 50 is dimensioned and configured for full load conditions, the spring rate with the conventional constant spring characteristic at low load conditions will be excessive. It will be seen from FIG. 5 that excessive force will be applied to the coal bed disposed intermediate the roll 22 and the bowl 14. This is represented graphically by the line A in FIG. 5.

Figure 3:
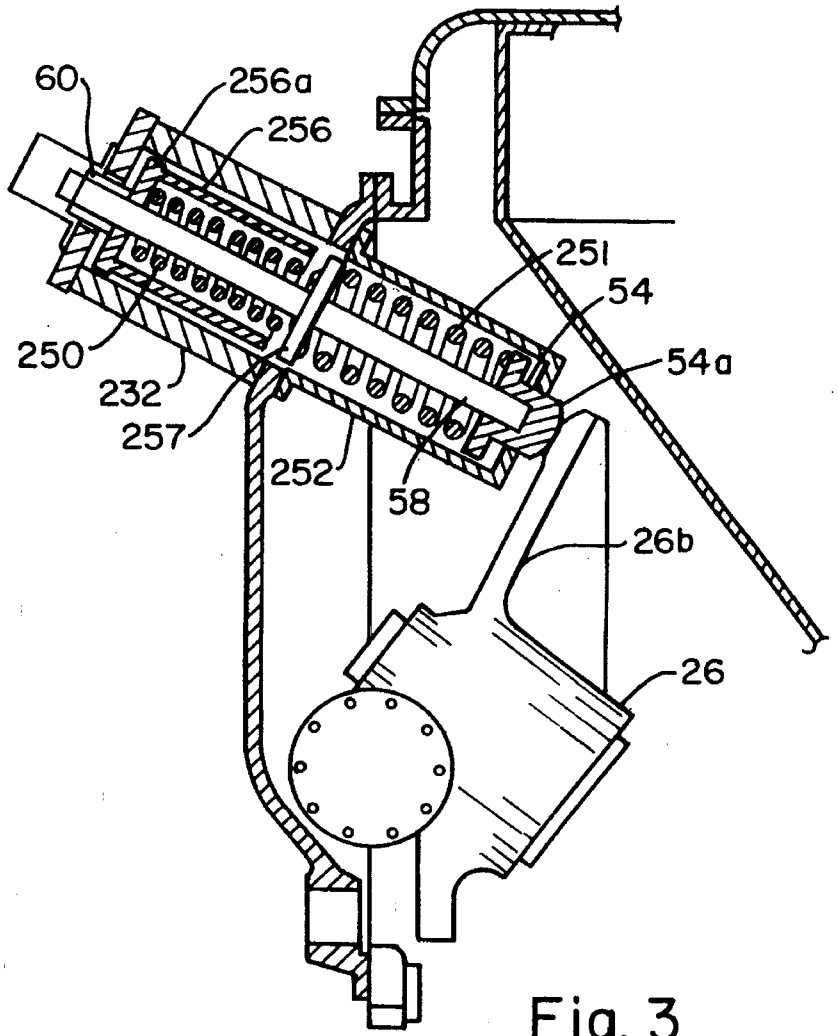
FIG. 3 is a few similar to FIG. 2 showing the spring assembly in accordance with one form of the present invention.

Referring now to FIG. 3 there is shown a series arrangement of two discrete springs having differing spring rates. The spring assembly is identified by the numeral 232. The canister is identified by the numeral 252 and it will be seen that it is longer than the canister 52 in FIG. 2. In this embodiment of the invention a sleeve shaped member 256 replaces the washer 56 of the prior art apparatus shown in FIG. 2. Disposed in generally axially aligned relationship within the sleeve 256 is a first spring 250 that extends between the end cap 256*a* of the sleeve 256 and a floating plate or washer 257. The second and larger spring 251 is disposed within the canister 252 and abuts the floating plate 257 and the seat 54. As in the prior art structure illustrated in FIG. 2 a nut 60 is provided to cooperate with the shaft 58 and provide preload on the springs 250 and 251.

It will be understood that the floating plate 257 is free to move axially within the canister 252. In operation, as the size of the coal bed intermediate the roll 22 and the bowl 14 increases the spring assembly to 232 will be compressed. Initially, the spring 250 will deflect before the spring 251 because the spring constant for the spring 250 is less. After initial deflection the floating plate 257 will abut the right (as viewed) extremity of a sleeve 256. This will have essentially the same in effect as if the coils of the spring 250 had moved into side abutting relationship (fully collapsed) relationship. Upon still further increase in the size of the coal bed, the spring 251 will deflect. The graphic representation of the spring rates produced by this assembly are illustrated in FIG. 5 by the line D.

Figure 4:
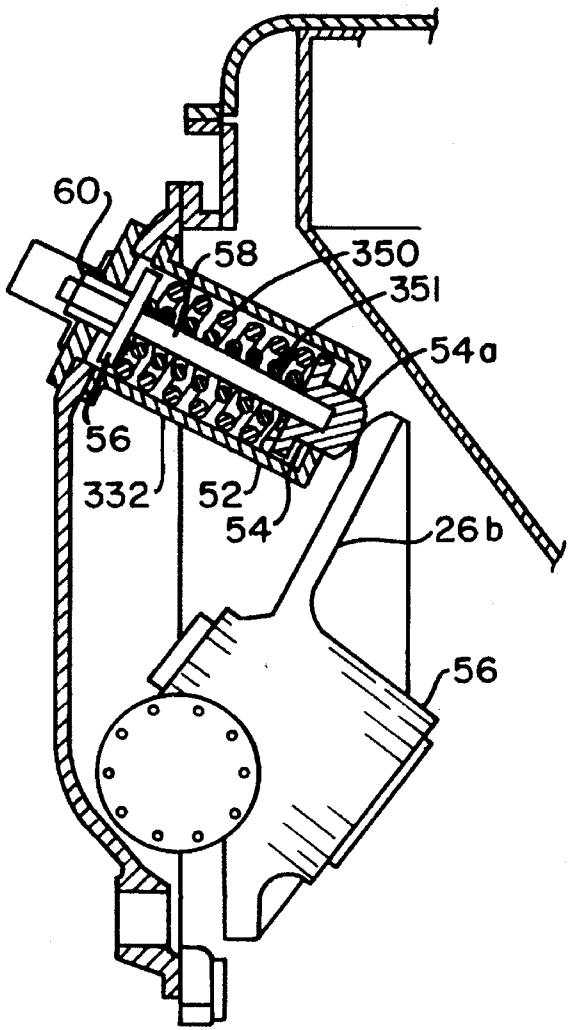
FIG. 4 is another view similar to FIG. 2 showing another form of the spring assembly in accordance with the present invention.

Referring now to FIG. 4 there is shown a second embodiment of the apparatus in accordance with the invention. In this embodiment two springs of differing spring rates are disposed in coaxial overlapping relationship. More specifically, a canister 52 similar to that shown in the prior art apparatus of FIG. 2 has a first relatively large spring 350 disposed in coaxial overlapping relationship with a smaller spring 351. Initially the smaller spring 351 is compressed to a preload condition by the nut 60, washer 56, shaft 58, and retainer 54. It will be seen that as the coal bed intermediate the roller 22 and the bowl 14 increases in thickness that the spring assembly 332 will be compressed. The initial compression will be only of the spring 351 which is stronger than the spring 350. Upon further increase in the size of the coal bed in the bowl 14 the spring assembly 332 will deflect further and this will cause both the spring 350 and spring 351 to be compressed. Accordingly, the graphic representation indicated by the line E in FIG. 5 illustrates the effective spring rate of the spring assembly 332. It will be seen that the spring rate is designed to change as the load increases beyond the low load condition. It will also be seen that the curve approximates the ideal conditions at as well as being much better than the compromises inherent in the lines A and B.

It will thus be seen that the apparatus in accordance with the invention allows better control of the pulverizer and more specifically will produce the required size of coal particles at both low and high or full load conditions. It will further be seen that this is achieved using only conventional fixed rate springs to produce a variable rate spring effect. Accordingly, the use of conventional springs will insure high reliability of the assembly. It will also be apparent to those skilled in the art that because only conventional springs are utilized in the apparatus in accordance with the invention, the cost will be reasonable.

The invention has been described with reference to its illustrated preferred embodiments. Persons skilled in the art of such devices may upon exposure to the teachings herein, conceive other variations. Such variations are deemed to be encompassed by the disclosure, the invention be delimited only by the following claims.

Having thus described my invention, I claim:

1. A pulverizer for crushing coal apparatus for use in a combustion process which comprises:

a bowl shaped body;

a roller dimensioned and configured for contact with at least a portion of said bowl shaped body;

means for causing relative movement between said bowl shaped body and said roller; and means for biasing said roller against said bowl shaped body, said means for biasing including a spring assembly, said spring assembly including a first spring and a second spring, said means for biasing including means causing initial compression of said first spring before said second spring is compressed.

2. The apparatus as described in claim 1 wherein:

said first spring and said second spring are coil springs and said first and second springs are compressed simultaneously after initial compression of said first spring.

3. The apparatus as described in claim 2 wherein:

said first and second springs are disposed in coaxial relationship with said second spring overlapping an axial part of said first spring.

4. The apparatus as described in claim 3 wherein:

said second spring has a free axial length that is less than the free axial length of said first spring.

5. The apparatus as described in claim 4 wherein:

said means allowing initial compression of said first spring before said second spring is compressed includes a washer disposed at one axial extremity of said first spring and a spring seat disposed at a second axial extremity of said first spring.

6. The apparatus as described in claim 5 wherein:

said apparatus includes a shaft extending between a spring retainer and said washer, said shaft including means for preloading said first spring without preloading said second spring.

7. The apparatus as described in claim 1 wherein:

said first spring and said second spring are disposed in substantially coaxial substantially end abutting relationship and said apparatus includes a floating plate disposed intermediate said first and second springs.

8. The apparatus as described in claim 7 wherein:

a sleeve shaped member surrounds at least an axial portion of said first spring.

9. The apparatus as described in claim 8 wherein:

said first spring has a lower spring constant than said second spring.

10. The apparatus as described in claim 9 wherein:

said generally sleeve shape member extends around a portion of the axial extent of said first spring, said sleeve shape member is dimensioned and configured for engagement with said floating plate after initial compression of said first spring whereby after contact of said sleeve shape member with said floating plate said first spring will not compress axially any further.

11. The apparatus as described in claim 10 wherein:

said apparatus includes means for compressing said first and second springs simultaneously whereby both said first and second springs are preloaded.

* * * * *